US010940990B1

(12) United States Patent
Musterman, IV

(10) Patent No.: US 10,940,990 B1
(45) Date of Patent: Mar. 9, 2021

(54) SPRAY FOAM CANISTER ADAPTER

(71) Applicant: Henry W. Musterman, IV, Onalaska, TX (US)

(72) Inventor: Henry W. Musterman, IV, Onalaska, TX (US)

( * ) Notice: Subject to any disclaimer, the term of this patent is extended or adjusted under 35 U.S.C. 154(b) by 0 days.

(21) Appl. No.: 15/871,489

(22) Filed: Jan. 15, 2018

Related U.S. Application Data

(60) Provisional application No. 62/448,421, filed on Jan. 20, 2017.

(51) Int. Cl.
*B65D 83/30* (2006.01)
*B65D 83/16* (2006.01)
*B05B 11/00* (2006.01)

(52) U.S. Cl.
CPC ..... *B65D 83/306* (2013.01); *B65D 83/16* (2013.01); *B05B 11/0008* (2013.01)

(58) Field of Classification Search
CPC ..... B05B 11/0005; B05B 11/0008; B65D 83/303; B65D 83/306; B65D 83/16
USPC ..... 239/525, 592, 597, 340; 222/402.13
See application file for complete search history.

(56) References Cited

U.S. PATENT DOCUMENTS 3,633,795 A * 1/1972 Brooks ..... B05B 7/1209 222/134
4,171,096 A * 10/1979 Welsh ..... B05B 7/0861 239/291
4,893,752 A 1/1990 Spink et al.
5,421,518 A * 6/1995 Robisch ..... B05B 7/064 239/311
5,450,983 A * 9/1995 Stern ..... B05B 1/02 222/1
5,549,226 A * 8/1996 Kopp ..... B65D 83/303 222/402.13
5,639,025 A * 6/1997 Bush ..... B05B 1/14 239/333
5,642,860 A * 7/1997 Bush ..... B05B 1/042 239/333
6,152,335 A * 11/2000 Stern ..... B05B 1/02 222/394
6,250,567 B1 * 6/2001 Lewis ..... B05B 7/0408 239/292
6,264,121 B1 * 7/2001 McClary ..... B05B 15/654 239/525
6,352,184 B1 * 3/2002 Stern ..... B05B 1/02 222/394
6,446,842 B2 9/2002 Stern et al.
6,779,746 B2 * 8/2004 Gromes, Sr. ..... B05B 1/10 239/596
6,883,688 B1 4/2005 Stern et al.
7,374,068 B2 * 5/2008 Greer, Jr. ..... B65D 83/306 222/1
7,389,941 B2 6/2008 Jackson
8,701,945 B2 * 4/2014 Hoagland ..... B65D 83/303 222/402.13

(Continued)

*Primary Examiner* — Joseph A Greenlund
(74) *Attorney, Agent, or Firm* — Cramer Patent & Design, PLLC; Aaron R. Cramer

(57) ABSTRACT

A spray foam canister adapter provides a means to attach a convenient trigger assembly to a commercially-available aerosol can containing a spray foam insulating material, for efficient spraying of the insulating material into tight or hard to reach spaces. The canister adapter also provides alternate nozzles and a ninety degree (90°) extension for specific insulation spraying applications.

1 Claim, 4 Drawing Sheets

(56) References Cited

U.S. PATENT DOCUMENTS

| | | | | |
|---|---|---|---|---|
| 8,720,747 | B2 * | 5/2014 | Hoagland | B65D 83/207 222/402.13 |
| 9,010,572 | B2 * | 4/2015 | Demey | B05B 1/3073 222/23 |
| 2004/0191449 | A1 | 9/2004 | Haynes et al. | |
| 2007/0158474 | A1 * | 7/2007 | Berger | B05C 17/00596 239/567 |
| 2007/0221540 | A1 | 9/2007 | Dziadzio et al. | |
| 2008/0073451 | A1 * | 3/2008 | Bradbury | B05B 1/04 239/599 |
| 2013/0264400 | A1 | 10/2013 | Crandley | |

* cited by examiner

SPRAY FOAM CANISTER ADAPTER

RELATED APPLICATIONS

The present invention was first described in and claims the benefit of U.S. Provisional Patent Application No. 62/448,421 filed on Jan. 20, 2017, the entire disclosures of which are incorporated herein by reference.

FIELD OF THE INVENTION

The invention relates generally to an adapter for the dispensing end of spray foam canisters.

BACKGROUND OF THE INVENTION

Energy consumption and utility usage continues to grow every day in our country. Recent headlines which depict skyrocketing utility rates, rolling blackouts, natural gas hikes, and shortages are definite signs that we need to reduce our consumption of these precious natural resource commodities. As consumers, proper insulation during building construction is perhaps the biggest step we can take to help control these costs.

One (1) recent development in building insulation which is frequently used is that of low cost aerosol based spray on insulation for filling in cracks and crevices around windows, doors, and similar small openings. While such a method works great for small areas, the use of large and costly two-part spray on kits are necessary for insulating wall cavities and similar larger areas. Do-it-yourselfers and homeowners perhaps only doing one wall stud cavity are typically left with no alternative other than to purchase an expensive kit or even hire a separate insulating contractor.

Accordingly, there exists a need for a means by which small sections of wall cavities and other medium sized areas can be easily covered by low cost spray on insulation. The use of the adapter provides a means of dispensing aerosol based spray foam over a larger area in a manner which is quick, easy, and effective.

SUMMARY OF THE INVENTION

In view of the foregoing disadvantages inherent in the prior art, it has been observed that there is need of an adapter to provide user selected flow of insulated foam from a pressurized canister, due to the type of nozzle attached thereto. In certain embodiments, the invention includes the trigger assembly. In such embodiments, the trigger assembly includes a first trigger connector capable removable connection to the canister of pressurized foam insulation, a flanged hollow trigger body capable of being in fluid communication with the canister of pressurized foam insulation, and a second trigger connector.

To achieve the above and other objectives, the present invention provides for such an adapter including an expansion chamber, an adapter connector capable of removably providing fluid communication between a first end of the expansion chamber and the second trigger connector of the trigger assembly, and a head portion having a domed end and an orifice located an apex of the domed end. The head portion removably attached to a second end of the expansion chamber.

In certain embodiments, the adapter connector is generally cylindrical.

In a at least one (1) embodiment, the expansion chamber is generally cylindrical and includes a tapered adapter nozzle having a first end capable of removable attachment to the adapter connector, and a second end having a larger diameter than said first end. In other embodiments, the expansion chamber is generally cubical and has a first face and a second face. The tapered adapter nozzle is located on the first face, having a first end capable of removable attachment to an adapter connector first side, and a second end. A nipple has a nipple first end affixed to the second face, extending away therefrom, and terminates in a nipple second end. The head portion is removably attached to the nipple second end.

In other embodiments, the head portion can have either a hex head configuration, or a knurled outer surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
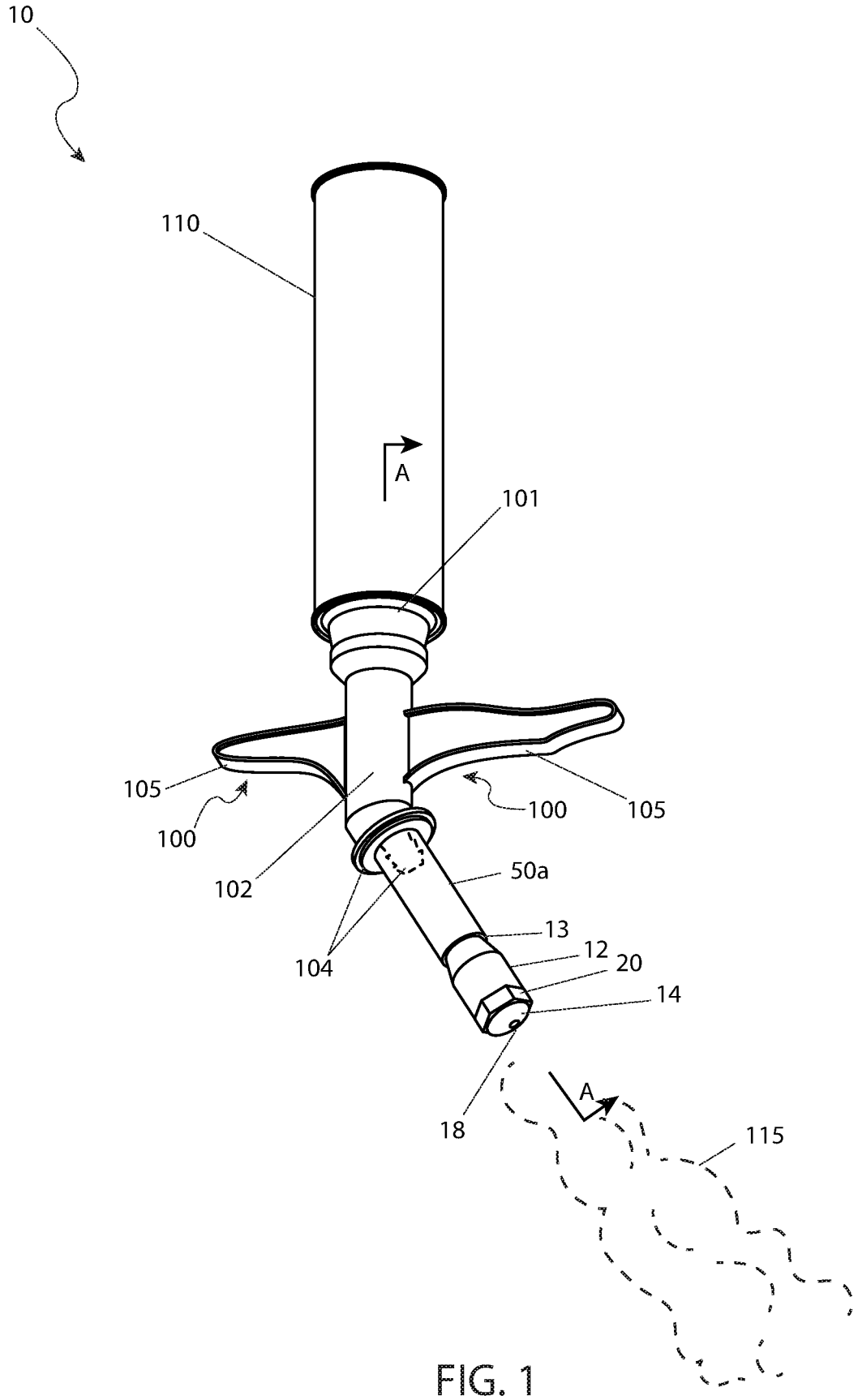
FIG. 1 is a perspective view of a spray foam canister adapter 10 assembled onto an existing aerosol can 110 via a first transition conduit 50*a*, according to a preferred embodiment of the present invention.

10 spray foam canister adapter
12 expansion chamber
13 adapter nozzle
14 domed end
15 alternate adapter nozzle
16 connection
17 alternate spray adapter
18 first nozzle orifice
20 hex head
30 knurled head
40 ninety degree (90°) expansion chamber
41 nipple
42 removable female nozzle
43 removable nozzle knurled portion
44 second nozzle orifice
45 ninety degree (90°) expansion chamber nozzle connector
47 first side wall
48 second side wall
50*a* first transition conduit
50*b* second transition conduit
52 transition conduit port
100 trigger assembly
101 trigger first connector
102 body
104 trigger second connector
105 grip
107 aperture
108 trigger assembly port
110 aerosol can

115 insulation material

DETAILED DESCRIPTION OF THE PREFERRED EMBODIMENT

Figure 2:
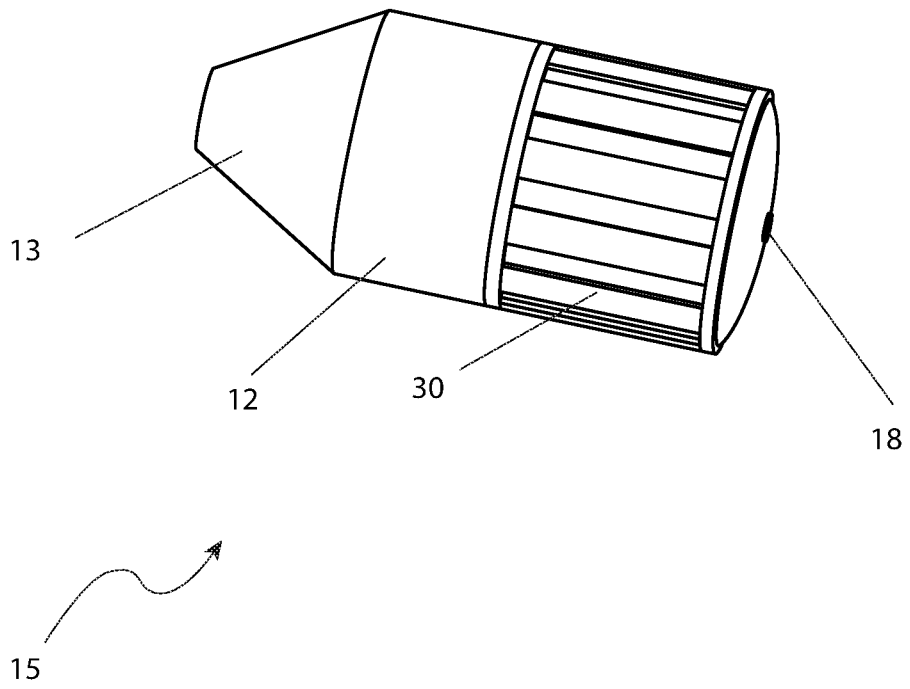
FIG. 2 is a perspective view an alternate adapter nozzle 15, according to an alternate embodiment of the present invention.
Figure 3:
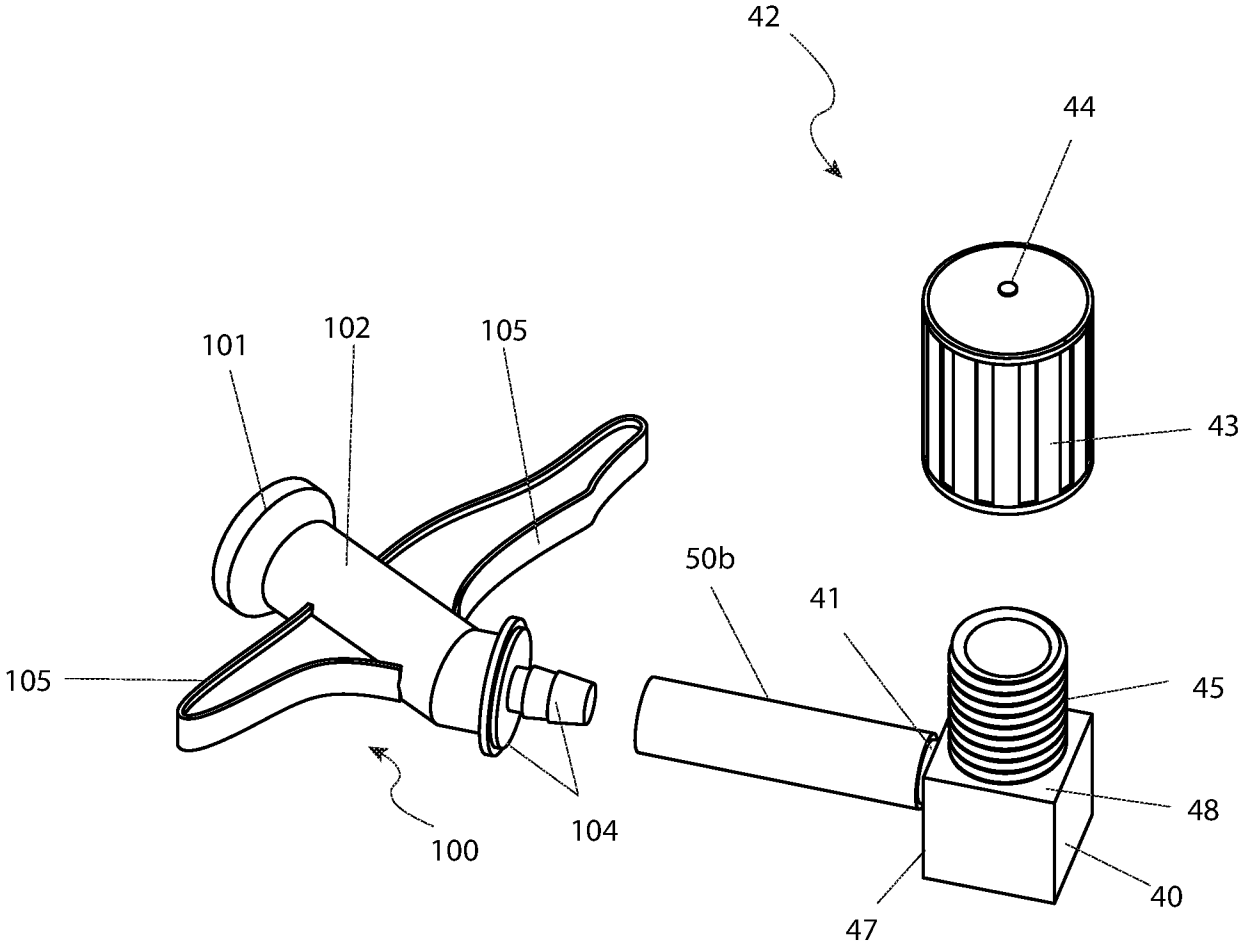
FIG. 3 is a disassembled perspective view of alternate spray adapter 17, trigger assembly 100, and removable female nozzle 42 portions, according to an alternate embodiment of the present invention; and, FIG. 4 is a sectional view of the foam canister adapter 10 taken along section line A-A (see FIG. 1), according to a preferred embodiment of the present invention.
Figure 4:
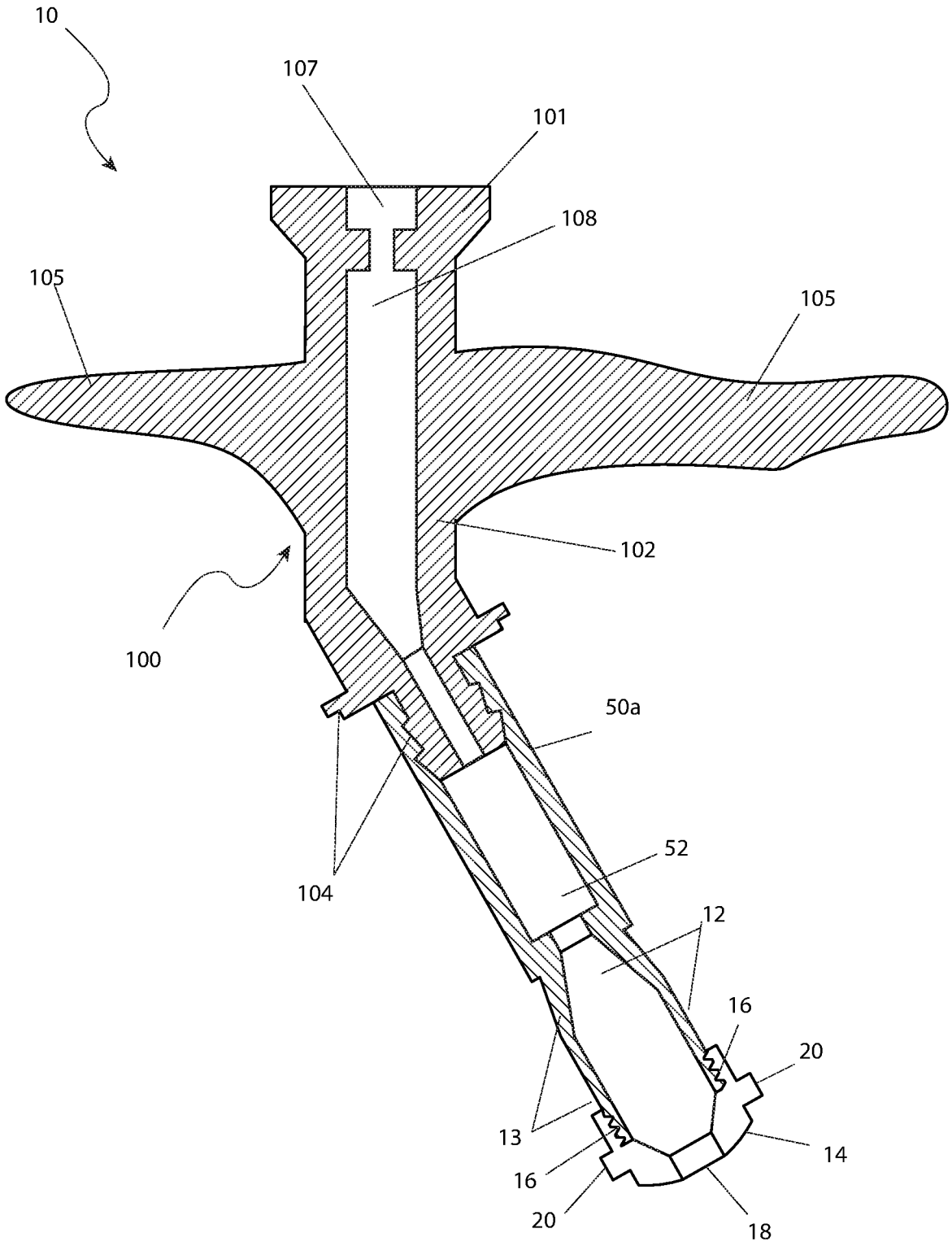

The best mode for carrying out the invention is presented in terms of its preferred embodiment, herein depicted within FIGS. 1 and 4, and in terms of alternate embodiments. herein depicted within FIGS. 2 and 3. However, the invention is not limited to the described embodiments, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a spray foam canister adapter (herein described as the "adapter") 10, which provides a means to attach a convenient trigger assembly 100 to an aerosol can 110 containing a spray foam insulating material 115, for efficient spraying of the insulating material 115 into tight or hard to reach spaces.

Referring now to FIGS. 1 and 4, perspective and sectional views of the adapter 10, according to a preferred embodiment of the present invention, are disclosed. The adapter 10 is intended to be used in conjunction with commercially available aerosol cans 110 of various insulation materials 115. The adapter 10 includes a trigger assembly 100 and an adapter nozzle 13. The trigger assembly 100 is envisioned to provide a unitary hollow molded-plastic structure having an internal trigger assembly port 108 having a substantial diameter so as to allow the insulation material 115 to travel through. The trigger assembly 100 would include a trigger first connector 101, a body 102 having at least one (1) integral grip 105, and a trigger second connector 104.

The trigger first connector 101 is located at a proximal end of the body portion 102 of the trigger assembly 100. The trigger first connector 101 provides a flanged cylindrical female shape providing removable attachment and fluid communication between the trigger assembly 100 and the aerosol can 110.

The trigger second connector 104 is located upon a distal end of the body 102 of the trigger assembly 100 and provides a flanged structure having a protruding cylindrical male feature suitable for removable press-fit attachment of the trigger assembly 100 to a correspondingly sized first transition conduit 50*a* portion (also see FIGS. 3 and 4). The first transition conduit 50*a* is envisioned to be made using a semi-rigid tubular material such as soft plastic, urethane rubber, or the like.

In use, a user would apply pressure to the grip 105, causing deflection of the trigger assembly 100, thereby initiating a flow of insulation material 115 from a stem portion of the aerosol can 110 allowing the insulation material 115 to subsequently flow through the body 102 and the adapter nozzle 13 portions.

The flanged portions of the trigger first connector 101 and the trigger second connector 104 allow a user to grip the trigger assembly 100 while holding the aerosol can 110 in the same hand. These flanges extend outwardly and are configured to provide the user substantial control and comfort while manipulating the trigger assembly 100 and spraying the insulating material 115. An embodiment of the trigger assembly 100 is shown here having a body portion 102 which terminates in an angled manner, thereby enabling comfortable operation by a user.

In the preferred embodiment, the adapter 10 provides a hollow molded-plastic first transition conduit 50*a*. A proximal female end portion of the first transition conduit 50*a* is affixed to the male trigger second connector 104. The elongated cylindrical first transition conduit 50*a* is to have an inner diameter suitable for secure attachment onto the male trigger second connector 104 via an interference fit. The elongated first transition conduit 50*a* allows the insulation material 115 to flow in a controlled fashion to a location at which a user wishes to apply the insulation material 115.

Attached to the distal end of the first transition conduit 50*a*, via a press-fit connection, is a tapered adapter nozzle 13 being inserted into the first transition conduit 50*a*. The adapter nozzle 13 provides integral portions including a hex head 20, an expansion chamber 12, and a domed end portion 14 which in turn has a central first orifice 18 from which a flow of expanding insulation material 115 exits the adapter 10 during use. As illustrated here, the adapter nozzle 13 includes an inwardly tapered proximal end portion and an outwardly tapering distal end portion. The outwardly tapering distal end of the adapter nozzle 13 transitions into a cylindrical expansion chamber 12 having a substantial hollow internal cavity (see FIG. 4). The expansion chamber 12 allows the insulation material 115 to expand and build up pressure. The expansion chamber 12 terminates at a removably attached domed end portion 14. The domed end 14 includes a small first orifice 18 being molded or bored through a central apex of the domed end 14, thereby providing in-line fluid communication with the interior of the expansion chamber 12. The first orifice 18 is much smaller relative to the diameter of the expansion chamber 12, the trigger assembly port 108, and the first transition conduit 50*a*. This diametrical arrangement allows pressure to build up in the expansion chamber 12, and thus forces the foam insulation material 115 through the first orifice 18 at a high velocity. It is envisioned that the domed end 14 and expansion chamber 12 portions are removably attached to each other using threads, a press-fit, or other method. The domed end 14 includes an integral hex head portion 20 enabling attaching and detaching of the domed end 14 from the expansion chamber 12 for cleaning and/or replacement purposes, as necessary. It is envisioned that the first orifice 18 may be sized to provide a nebulizing or atomizing distribution of the insulating material 115, if desired. Furthermore, it is envisioned that the adapter 10 may be provided with a plurality of domed ends 14 having different-sized first orifices 18 to produce desired insulation spraying results.

As seen in FIG. 4, the trigger first connector portion 101 of the trigger assembly 100 includes an aperture 107 and a trigger assembly port 108 through which a stream of insulating material 115 flows during use of the adapter 10. The aperture 107 is to be shaped and sized so as to receive and secure the trigger first connector 101 onto a stem portion of an existing aerosol can 110. The aperture 107 is in fluid communication with the transition conduit port 52, thereby subsequently conveying the pressurized insulating material 115 into the expansion chamber 12, and subsequently being sprayed out of the first orifice 18.

The expansion chamber 12 and domed end 14 are illustrated here being removably attached to each other via a threaded connection 16; however, it is understood that other forms of attachment such as a snapping-fit, or similar method may also be utilized. The domed end 14 includes an integral hex head portion 20 enabling attaching and detaching of the domed end 14 from the expansion chamber 12 for cleaning and/or replacement purposes, as necessary.

Referring now to FIG. 2, a perspective view of an alternate adapter nozzle 15, according to an alternate embodiment of the present invention, is disclosed. The alternate adapter nozzle 15 provides similar construction and function as the aforementioned adapter nozzle 13, but having a knurled head portion 30 in lieu of the aforementioned hex head portion 20 of the preferred adapter 10. The knurled head 30 is intended to provide ease of attachment and detachment.

Referring now to FIG. 3, showing an alternate spray adapter 17, according to an alternate embodiment of the present invention, is disclosed. In this configuration, a ninety degree (90°) expansion chamber 40 is provided, having a general cubic shape. The alternate spray adapter 17 also includes a second transition conduit 50*b*, a nipple 41, and a removable female nozzle portion 42. The ninety degree (90°) expansion chamber 40 is provided to enable better use of the invention in tight spaces or in applications where the ninety degree (90°) bend is required or desired for ease in application or user comfort.

The second transition conduit 50*b* is envisioned to provide similar construction and materials as the aforementioned first transition conduit 50*a*. The nipple 41 extends outwardly from a first side wall portion 47 of the ninety degree (90°) expansion chamber 40, providing a secure high-friction fit into the second transition conduit 50*b*. The ninety degree (90°) expansion chamber nozzle connector 45 extends upward from a second side wall portion 48, being orientated ninety degrees (90°) from the first side wall 47, and is envisioned to take the form of a threaded male nipple body. A removable female nozzle 42 is provided being removably attachable to the ninety degree (90°) expansion chamber nozzle connector 45. The removable female nozzle 42 is to sized and shaped so as to threadingly engage the ninety degree (90°) expansion chamber nozzle connector 45. The removable female nozzle 42 also incorporates a domed end with a second nozzle orifice 44. In the illustrated embodiment, the removable female nozzle 42 has a removable nozzle knurled outer surface 43 but could incorporate a hex head surface in other embodiments, if desired.

The trigger second connector 104, as seen here, provides a flanged structure having a protruding cylindrical male feature having a barbed surface or similar surface suitable for removable press-fit attachment to the correspondingly sized first transition conduit 50*a* and the second transition conduit 50*b*.

The exact specifications, materials used, and method of use of the adapter 10 may vary upon manufacturing. Any of the adapters 10, 17, and nozzles 13, 15, as well as the trigger assembly 100 and transition conduits 50*a*, 50*b* can be manufactured out of similar or identical materials to enable ease of manufacturing and ease of connectivity between the elements. The material should be resilient and inert enough to withstand the internal pressures of the material within the foam kit as well as normal wear and tear during usage. The adapters 10, 17 and nozzles 13, 15 can employ any exterior geometry for smoothness or aesthetic purposes, yet still retain their features described herein.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the adapter 10, it would be installed as indicated in FIG. 1.

The method of utilizing the preferred embodiment of the adapter 10 may be achieved by performing the following steps: procuring a model of the adapter 10 having a desired number of domed end portions 14 and corresponding first orifices 18; pressing the first transition conduit 50*a* onto the trigger second connector 104, if not previously installed; pressing the tapered end portion of the adapter nozzle 13 into the remaining end of the first transition conduit 50*a*, if not previously installed; affixing a domed end portion 14 onto the adapter nozzle 13 having a first orifice 18 of a desired size; pressing the aperture portion 107 of the trigger first connector 101 onto the stem portion of an aerosol can 110 full of a desired insulation material 115; pressing upon at least one (1) grip portion 105 of the trigger assembly 100 to deflect the trigger assembly 100 and initiate a flow of the insulation material 115 from the aerosol can 110; allowing the insulation material 115 to flow through the first transition conduit 50*a*, expansion chamber 12, and out of the first orifice 18 as needed; repeating the above steps until exhausting a supply of insulation material 115 from the aerosol can 110; replacing the spent aerosol can 110 with a new aerosol can 110; repeating the above steps until completing the spray foam insulation project; and, benefiting from a convenient and adaptable means to spray insulation material 115 into tight or hard to reach spaces, afforded a user of the present invention 10.

The method of utilizing the alternate adapter nozzle 15 may be achieved by replacing the adapter nozzle 13 with the alternate adapter nozzle 15; inserting the alternate adapter nozzle 15 into the first transition conduit 50*a* in a similar manner as the preferred adapter nozzle 13; and, following the previous insulation spraying steps.

The method of utilizing the alternate adapter 17 and removable female nozzle 42 portions to perform a particular insulation spraying project may be achieved by replacing the first transition conduit 50*a* with the second transition conduit 50*b*; affixing the ninety degree (90°) expansion chamber 40 and removable female nozzle 42 portion, if not previously attached, and, completing the foam insulation project using the previously described steps.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A spray foam cannister adapter, consisting of:

an expansion chamber;

an adapter connector removably providing fluid communication between a first end of said expansion chamber and a trigger assembly, said adapter connector is in fluid communication with said trigger assembly;

a head portion having a domed end and an orifice located at an apex of said domed end, said head portion removably attached to a second end of said expansion chamber and said head portion having a hex head configuration; and wherein said expansion chamber further comprises:

a tapered adapter nozzle having a first end removably attached to said adapter connector and a second end having a larger diameter than said first end; and a generally cylindrical chamber body integral with said adapter nozzle second end;

wherein said adapter connector is generally cylindrical;

wherein said orifice of said head portion is substantially smaller in diameter than said chamber body; and wherein the spray foam cannister adapter is for a dispensing end of a spray foam canister.

* * * * *